United States Patent [19]

Shankar et al.

[11] Patent Number: 4,526,814

[45] Date of Patent: Jul. 2, 1985

[54] METHODS OF FORMING A PROTECTIVE DIFFUSION LAYER ON NICKEL, COBALT, AND IRON BASE ALLOYS

[75] Inventors: Srinivasan Shankar, Branford; G. William Goward, New Haven, both of Conn.

[73] Assignee: Turbine Components Corporation, Branford, Conn.

[21] Appl. No.: 443,036

[22] Filed: Nov. 19, 1982

[51] Int. Cl.[3] ..... C23C 11/00

[52] U.S. Cl. ..... 427/253; 427/252; 427/383.9

[58] Field of Search ..... 148/6.35, 6.3; 427/253, 427/383.9, 252

[56] References Cited

U.S. PATENT DOCUMENTS 4,041,196 8/1977 Baldi ..... 427/253

4,070,507 1/1978 Stuber ..... 427/383.9

*Primary Examiner*—Sam Silverberg

*Attorney, Agent, or Firm*—Buell, Ziesenheim, Beck & Alstadt

[57] ABSTRACT

Methods are provided for forming protective diffusion layers on nickel, cobalt and iron base alloy parts comprising the formation of a diffusion layer of platinum, chromium and aluminum on said surfaces either by deposition of platinum and gas phase chromizing followed by aluminizing or by gas phase chromizing and deposition of platinum followed by aluminizing, or by gas phase chromizing followed by aluminizing and deposition of platinum, said gas phase chromizing performed out of contact with a source of gaseous chromizing species at elevated temperature, said aluminizing performed either out of contact or in contact with a powder mixture at elevated temperature.

29 Claims, 6 Drawing Figures

500 X

500 X

500 X

METHODS OF FORMING A PROTECTIVE DIFFUSION LAYER ON NICKEL, COBALT, AND IRON BASE ALLOYS

This invention relates to methods of forming a protective diffusion layer on nickel, cobalt and iron base alloys and particularly to a method of forming a diffusion layer of combined platinum, chromium, and aluminum on nickel, cobalt and iron base alloys.

It has long been known to apply a diffusion layer of aluminum on nickel, cobalt and iron base alloy parts by pack cementation processes which involve packing such parts in a bed of powdered mixture consisting of a source of aluminum and an inert material and heated to elevated temperature (e.g. 1400°-2000° F.) for several hours to diffuse aluminum into the surfaces of the alloy parts being treated.

It has also been proposed to improve the oxidation and corrosion resistance of such articles by first coating the alloy part with a platinum group metal by electrodeposition or other means and then to aluminize the platinum plated part by pack cementation. Such a process is taught in Bungardt et al. U.S. Pat. No. 3,677,789.

It has been proposed also in Benden et al. U.S. Pat. No. 4,148,275 to diffusion aluminize passages in metal parts by connecting the passages to a manifold and forcing a carrier gas over a heated bed of a source of aluminum and an inert filler and into the passages through the manifold.

Such protective diffusion layers are particularly advantageous for gas turbine engine components and the like which are subject to high temperatures and oxidative and hot corrosive environments.

Many such parts are of relatively complex design having internal passages and the like which are not in contact with the source of aluminum and inert material used in pack cementation and which are not only not coated but may become clogged or obstructed with the powdered mixture during the pack cementation process and must be cleaned. Such parts may also have areas which are subjected to less corrosive environments and which therefore require less protective coating than others.

The present invention is designed in part to solve the problems of treating such articles which cannot be satisfactorily or economically treated by prior art processes.

This invention provides a method and product in which a platinum group metal coating is applied to those surfaces subject to the most extreme heat and oxidative and hot corrosive conditions, the platinum surface and part are then gas phase chromized out of contact with a mixture of chromium, an activator and an inert filler material and thereafter the part is gas phase aluminized out of contact with a mixture of or subject to a pack aluminizing treatment in a mixture of aluminum or aluminum alloy, an activator and an inert filler material at elevated temperature. Preferably the platinum group metal is platinum. The coated part may be heat treated at elevated temperatures in vacuum or inert atmosphere between about 1500° F. to 2000° F. for up to 10 hours before subjecting the same to gas phase chromizing. Such heat treatment is preferably in the range of 1 to 5 hours, however, it may be omitted. The gas phase chromizing is preferably carried out at 1200° F. to 2100° F. for 1 to 20 hours. Gas phase aluminizing or pack aluminizing is also preferably carried out at temperatures in the range 1200° F. to 2100° F. for time periods of 1 to 20 hours depending upon the depth of diffusion layer desired. Preferably platinum coating of the part is by electroplating with the platinum plating thickness between about 0.0001 inch and 0.0007 inch. Gas phase chromizing is preferably carried out above a mixture of about 1% to 30% of a source of chromium, up to about 40% activator (usually a halide) and the balance an inert filler material such as aluminum oxide. Preferably the gas phase aluminizing or pack aluminizing is carried out above or in a mixture respectively of 1% to 35% of a source of aluminum, up to 40% activator (usually a halide) and the balance inert filler. Preferably the total combined diffusion layer of platinum, chromium and aluminum is about 0.0005 to 0.004 inches (0.5 mil to 4 mil) thick.

In the foregoing general description of this invention certain objects, purposes and advantages have been set out. Other objects, purposes and advantages of this invention will be apparent from a consideration of the following descriptions and the drawings in which.

Figure 1:
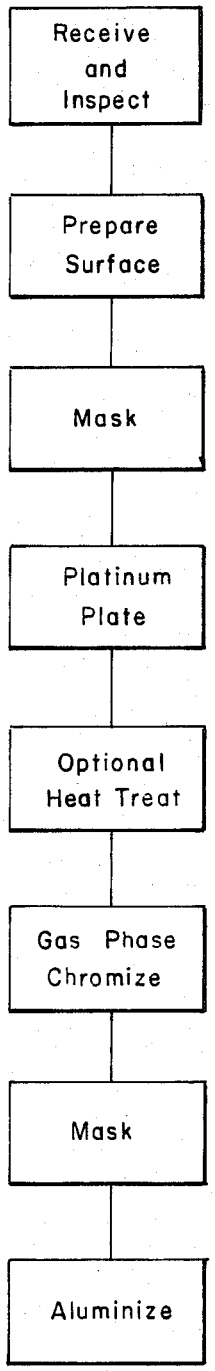
FIG. 1 is a flow diagram of one of the preferred versions of this invention.

The flow diagram of FIG. 1 illustrates one of the preferred process steps of this invention; namely inspect, prepare (degrease, blast, rinse), mask areas not to be plated, plate with platinum, optionally heat treat to diffuse the platinum, mask areas not to be coated, gas phase chromize and then aluminize.

Figure 2:
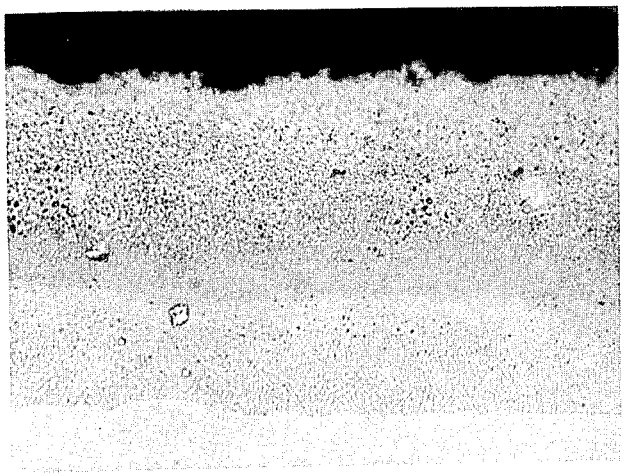
FIG. 2 is a micrograph of a diffusion coating of platinum, chromium and aluminum according to the practice set out in FIG. 1.

The practice will be better understood by reference to the following example. A turbine blade having cooling passages was inspected, degreased, blast cleaned and electroplated on critical surfaces with platinum to a thickness of 0.0003 inches. The plated turbine blade was heat treated at about 1900° F. for 3 hours in argon atmosphere to diffuse the platinum into the surfaces. The blade was then placed above and out of contact with a source of gaseous chromizing species heated to about 1950° F. for 8 hours. The source of chromizing species was in this case a mixture of about 20% chromium, about 2% halide activator and the balance aluminum oxide. The blade was then immersed in a mixture containing a source of aluminum, an activator and an inert filler, and heated to about 1400° F. for 5 hours. The mixture of powder was in this case 15% of an alloy containing aluminum, 2% halide activator and the balance aluminum oxide. The final surface section is illustrated in FIG. 2.

The parts treated according to this version of the invention are much more resistant to hot corrosion than like parts aluminized by pack cementation as in Pat. No. 3,677,789 and Pat. No. 4,148,275.

It has been found that a similar desired microstructure and environmental resistance can also be obtained by doing the gas phase chromizing first followed by the platinum application and aluminizing steps.

Figure 3:
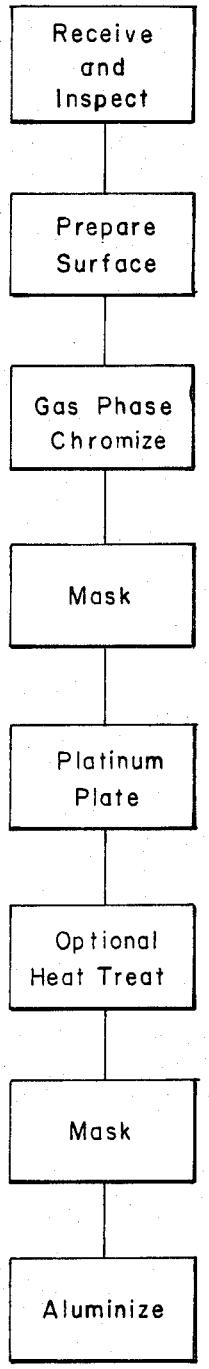
FIG. 3 is a flow diagram of another embodiment of this invention.
Figure 4:
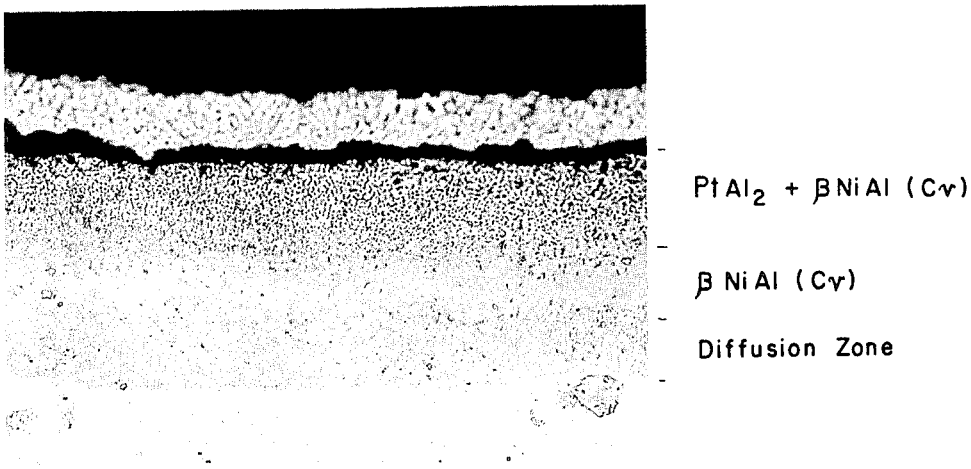
FIG. 4 is a micrograph of a diffusion coating of chromium, platinum and aluminum fabricated according to the practice set out in FIG. 3.

FIG. 3 is a flow diagram of a preferred version of this second embodiment and, FIG. 4 is micrograph of a diffusion coating of chromium, platinum, and aluminum fabricated according to the practice set out in FIG. 3.

The flow diagram of FIG. 3 illustrates another process according to this invention; namely inspect, prepare (degrease, blast, rinse), gas phase chromize, mask areas not to be plated, plate with platinum, optionally heat treat to diffuse the platinum, mask areas not to be coated and aluminize.

This practice will be better understood by reference to the following example. A turbine blade having cooling passages was inspected, degreased, blast cleaned, and gas phase chromized in which the turbine blade was coated above and out of contact with a source of gaseous chromizing species heated to about 1950° F. for 8 hours. The source of chromizing species was in this case a mixture of about 20% chromium, about 2% halide activator, and the balance aluminum oxide. Then the chromized turbine blade was electroplated with platinum on critical surfaces to a thickness of 0.0003 inches. Then the blade was immersed in a mixture containing a source of aluminum, an activator, and an inert filler, heated to about 1400° F. for 5 hours. The mixture of powder was in this case 15% of an alloy containing aluminum, 2% halide activator and the balance aluminum oxide. The final surface section is illustrated in FIG. 4.

The parts treated according to this version of the invention are much more resistant to hot corrosion than like parts aluminized by pack cementation as in Pat. No. 3,677,789 and Pat. No. 4,148,275.

Figure 5:
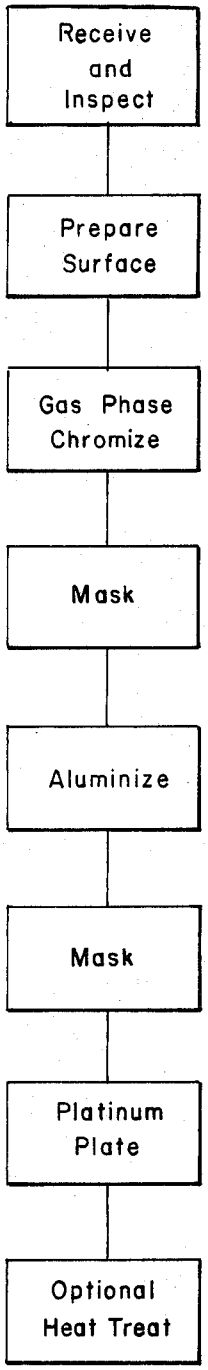
FIG. 5 is a flow diagram of a further embodiment of this invention.
Figure 6:
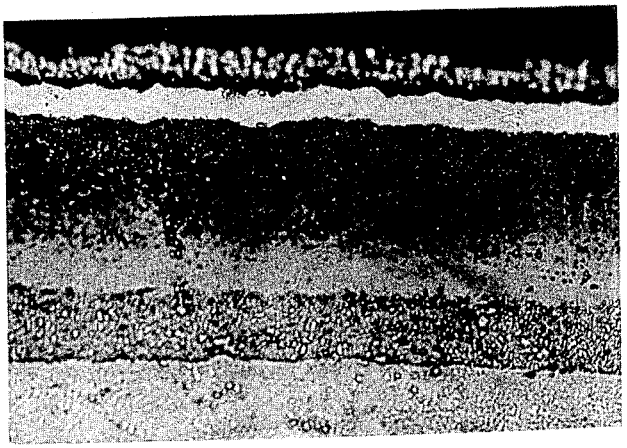
FIG. 6 is a micrograph of a diffusion coating of chromium, aluminum and platinum fabricated according to the process outlined in FIG. 5.

Another embodiment of this invention is illustrated in FIG. 5; namely inspect, prepare (degrease, blast, rinse), gas phase chromize, mask areas not to be coated, aluminize, mask areas not to be plated, and plate with platinum. FIG. 6 is a micrograph of a diffusion coating of chromium, aluminum, and platinum fabricated according to the practice set out in FIG. 5.

This practice will be better understood by reference to the following example. A turbine blade having cooling passages was inspected, degreased, blast cleaned, and gas phase chromized in which the turbine blade was coated above and out of contact with a source of gaseous chromizing species heated to about 1950° F. for 8 hours. The source of chromizing species was in this case a mixture of about 20% chromium, about 2% halide activator, and the balance aluminum oxide. Then the chromized turbine blade was aluminized by immersing in a mixture containing a source of aluminum, an activator, and an inert filler, heated to about 1400° F. for 5 hours. The mixture of powder was in this case 15% of an alloy containing aluminum, 2% halide activator, and the balance aluminum oxide. Then the turbine blade with surfaces enriched in chromium and aluminum was electroplated with platinum on critical surfaces to a thickness of 0.0003 inches. The final surface section is illustrated in FIG. 6.

The parts treated according to this version of the invention are much more resistant to hot corrosion than like parts aluminized by pack cementation as in Pat. No. 3,677,789 and Pat. No. 4,148,275.

The process of this invention may be applied to original manufactured parts or to remanufactured or rehabilitated parts.

In the foregoing specification certain preferred practices and embodiments of this invention have been set out, however, it will be understood that this invention may be otherwise embodied within the scope of the following claims.

We claim:

1. A method for forming a protective diffusion layer of chromium, platinum group metal and aluminum on nickel, cobalt and iron base alloy parts comprising the steps of depositing a coating of a platinum group metal on the surface of the part to be protected, forming a diffusion layer of platinum group metal and chromium on said surfaces by gas phase chromizing said surfaces out of contact with a source of gaseous chromizing species at elevated temperature, and forming a diffusion layer of platinum group metal, chromium and aluminum on said surfaces by aluminizing said surfaces at elevated temperature.

2. A method for forming a protective diffusion layer on nickel, cobalt, and iron base alloy parts as claimed in claim 1 comprising the steps of forming a diffusion layer of chromium by gas phase chromizing on the surface of the part to be protected, depositing a coating of a platinum group metal on the surface of the part to be protected, and forming a diffusion layer of chromium, platinum group metal, and aluminum on said surface by aluminizing said surfaces at elevated temperature.

3. A method for forming a protective diffusion layer on nickel, cobalt, and iron base alloy parts as claimed in claim 1 comprising the steps of forming a diffusion layer of chromium by gas phase chromizing on the surface of the part to be protected, followed by formation of a diffusion layer of chromium and aluminum by aluminizing said surfaces at elevated temperature, followed by deposition of a platinum group metal on the surface of the part to be protected.

4. The method of claim 1 or 2 or 3 wherein the platinum group metal is platinum.

5. The method of claim 1 or 2 or 3 wherein the platinum group metal coating is applied by one of electroplating, dipping, spraying, vapor deposition, sputtering, and mechanical plating.

6. A method as claimed in claim 4 wherein the platinum coating is applied by one of electroplating, dipping, spraying, vapor deposition, sputtering, and mechanical plating.

7. The method as claimed in claim 1 or 2 or 3 wherein the gas phase chromizing is carried out by holding the part at elevated temperature above and spaced from a mixture consisting of a source of chromium, and activator, and an inert filler.

8. A method as claimed in claim 4 wherein the gas phase chromizing is carried out by holding the part at elevated temperature above and spaced from a pack consisting of a source of chromium, an activator and an inert filler.

9. A method as claimed in claim 6 wherein the gas phase chromizing is carried out by holding the part above and spaced from a pack consisting of a source of chromium, an activator, and an inert filler.

10. The method as claimed in claim 1 or 2 or 3 wherein the part coated with platinum group metal is heated to diffuse the platinum group metal into the surfaces of the part.

11. A method as claimed in claim 10 wherein the part is heated to a temperature between about 1500° F. and 2000° F. in one of a vacuum or inert atmosphere for one to five hours.

12. A method as claimed in claim 4 wherein the part coated with platinum is heated to diffuse the platinum into the surfaces of the part.

13. A method as claimed in claim 13 wherein the part is heated to a temperature between about 1500° F. and 2000° F. in one of a vacuum or inert atmosphere for one to five hours.

14. The method as claimed in claim 1 or 2 or 3 wherein gas phase chromizing is carried out at a temperature between about 1200° F. and 2100° F. in one of a vacuum, an inert atmosphere and a reducing atmosphere for 1 to 20 hours.

15. A method as claimed in claim 4 wherein gas phase chromizing is carried out at a temperature between about 1200° F. and 2100° F. in one of a vacuum, an inert atmosphere and a reducing atmosphere for 1 to 20 hours.

16. A method as claimed in claim 6 wherein the mixture consists essentially of about 1 to 35% of one or more of the group consisting of chromium and chromium alloys, up to about 40% activator and the balance aluminum oxide filler.

17. A method as claimed in claim 8 wherein the mixture consists essentially of about 1 to 35% of one or more of the group consisting of chromium and chromium alloys, up to about 40% activator and the balance aluminum oxide filler.

18. The method as claimed in claim 1 or 2 or 3 wherein the aluminizing is carried out at elevated temperature in a mixture or above a mixture consisting of a source of aluminum, an activator, and an inert filler.

19. A method as claimed in claim 4 wherein the aluminizing is carried out at elevated temperature in a mixture or above a mixture consisting of a source of aluminum, an activator, and an inert filler.

20. A method as claimed in claim 6 wherein the aluminizing is carried out at elevated temperature in a mixture or above a mixture consisting of a source of aluminum, an activator, and an inert filler.

21. The method as claimed in claim 1 or 2 or 3 wherein the aluminizing is carried out at a temperature between about 1200° F. and 2100° F. in one of a vacuum, an inert atmosphere and a reducing atmosphere for 1 to 20 hours.

22. A method as claimed in claim 4 wherein the aluminizing is carried out at temperature between about 1200° F. and 2100° F. in one of a vacuum, an inert atmosphere and a reducing atmosphere for 1 to 20 hours.

23. A method as claimed in claim 18 wherein the mixture consists essentially of about 1 to 35% of one or more of the group consisting of aluminum and aluminum alloys, up to about 40% activator and the balance aluminum oxide filler.

24. A method as claimed in claim 19 wherein the mixture consists essentially of about 1 to 35% of one or more of the group consisting of aluminum and aluminum alloys, up to about 40% activator and the balance aluminum oxide filler.

25. A method as claimed in claim 7 wherein the aluminizing is carried out at elevated temperature in a mixture or above a mixture consisting of a source of aluminum, an activator, and an inert filler.

26. A method as claimed in claim 8 wherein the aluminizing is carried out at elevated temperature in a mixture or above a mixture consisting of a source of aluminum, an activator, and an inert filler.

27. A method as claimed in claim 25 wherein the aluminizing is carried out at elevated temperature in a mixture or above a mixture consisting of a source of aluminum, an activator, and an inert filler.

28. A method as claimed in claim 14 wherein the aluminizing is carried out at a temperature between about 1200° F. and 2100° F. in one of a vacuum, an inert atmosphere, and a reducing atmosphere for 1 to 20 hours.

29. A method as claimed in claim 15, wherein the aluminizing is carried out at a temperature between about 1200° F. and 2100° F. in one of a vacuum, an inert atmosphere, and a reducing atmosphere for 1 to 20 hours.

* * * * *

UNITED STATES PATENT AND TRADEMARK OFFICE

CERTIFICATE OF CORRECTION

PATENT NO. : 4,526,814

DATED : July 2, 1985

INVENTOR(S) : SRINIVASAN SHANKAR and WILLIAM GOWARD

It is certified that error appears in the above-identified patent and that said Letters Patent is hereby corrected as shown below:

Column 5, line 1, change "13" to --12--.

Signed and Sealed this

*First* Day of *October 1985*

[SEAL]

*Attest:*

DONALD J. QUIGG

*Attesting Officer*

*Commissioner of Patents and Trademarks—Designate*